United States Patent [19]

Probst

[11] Patent Number: 4,744,205

[45] Date of Patent: May 17, 1988

[54] CASE PACKING HEAD

[75] Inventor: Timothy F. Probst, North Canton, Ohio

[73] Assignee: Figgie International, Richmond, Va.

[21] Appl. No.: 930,781

[22] Filed: Nov. 14, 1986

[51] Int. Cl.[4] ..... B65B 35/44; B65B 39/02; B65B 5/06

[52] U.S. Cl. ..... 53/539; 53/543; 53/247; 53/248

[58] Field of Search ..... 53/247, 539, 544, 543, 53/261, 248

[56] References Cited

U.S. PATENT DOCUMENTS

| | | | |
|---|---|---|---|
| 2,358,447 | 9/1944 | Creamer | 53/539 X |
| 2,615,289 | 10/1952 | Hickin | 53/543 X |
| 2,657,845 | 11/1953 | Smith | 53/539 |
| 2,755,611 | 7/1956 | McGihon | 53/544 X |
| 3,052,071 | 9/1962 | Copping | 53/539 X |
| 3,142,947 | 8/1964 | Walter | 53/247 X |
| 3,431,702 | 3/1969 | Spaulding | 53/539 X |
| 3,672,117 | 6/1972 | Shuttleworth et al. | 53/247 X |
| 4,231,213 | 11/1980 | Okazaki | 53/539 X |

*Primary Examiner*—Horace M. Culver

*Attorney, Agent, or Firm*—Oldham, Oldham & Weber Co.

[57] ABSTRACT

A case packing head for the packing of rectangular containers into cases. In a first embodiment of the invention, the containers are passed through arcuate paths on skid blades such that the containers fan apart above the top edges of the cross fingers of the packing head, avoiding the cross fingers upon shifting of the skid blades. In another embodiment, the skid blades are angled downwardly and the stop blocks are adapted to withdraw a sufficient amount to allow the containers to tilt on the skide blades and separate. A separating grid is then driven between the containers to space them apart with the spaces positioned above the top edges of the cross fingers. In yet another embodiment, the skid blade assembly comprises a pair of blades, one slidable upon the other. The stop block is connected to the sliding blade which has teeth thereon for contacting the containers. Upon actuation, the stop block withdraws a fixed amount and the movable skid blade moves the same amount, the teeth contacting the containers and separating them from each other to define spaces therebetween over the top edges of the cross fingers.

19 Claims, 4 Drawing Sheets

CASE PACKING HEAD

TECHNICAL FIELD

The invention herein resides in the art of article handling equipment and, more particularly, to heads for case packing machinery in which cartons or cases are filled with containers in preset configurations. Specifically, the invention relates to a case packing head which is adapted for packing rectangularly shaped containers into such cases.

BACKGROUND ART

Various types of case packers have been previously known. The general type of interest is that in which an oncoming line of containers approaches a packing head while empty cases approach a case lift below the head. When the grid of the case packing head contains a full complement of containers, the case is lifted to a point immediately beneath the head, skid blades in the head are shifted, and the containers drop through a plurality of fingers into appropriate pockets or locations in the case below. The filled case is then lowered on the case lift and replaced with an empty case and the process repeats. Typically, the containers comprise bottles and the cartons or cases are partitioned into compartments or pockets for receiving the bottles.

The concept of the prior art works fine with bottles or containers which are of a generally round configuration in cross section. This is true because round bottles pass through the generally square passages of the picking head allowing for ample clearance at the corners of the passages such that the bottles or containers do not hang-up on top edges of the fingers. However, the passing of square or rectangular containers or boxes through such passages often results in the containers being caught by the top edge of cross fingers suspended beneath the grid, jamming the operation of the head and inhibiting operation of the packing line.

A particular problem has been experienced where boxes having a square or rectangular cross section are to be passed through passages having a corresponding cross section in the packing head grid and then into corresponding pockets in a case or carton. While containers typically clear the top edges of the longitudinal fingers attached and parallel to the lane dividers of the grid, they have a tendency to contact the top edges of the cross fingers which are connected and extend normal to the lane dividers of the grid. Such contact prevents the containers from passing through the fingers and into the case below, resulting in the jamming discussed above.

DISCLOSURE OF INVENTION

In light of the foregoing, it is a first aspect of the invention to provide a case packing head for reliably packing rectangular containers in cases.

Another aspect of the invention is to provide a case packing head wherein containers are precisely aligned with respect to passages in the head which communicate with pockets in the case.

Yet another aspect of the invention is the provision of a case packing head wherein containers to be packed in a case are separated from each other in the head.

Yet another aspect of the invention is the provision of a case packing head which is reliable, durable, and cost effective in operation, while being readily constructed utilizing state of the art elements.

The foregoing and other aspects of the invention which will become apparent as the detailed description proceeds are achieved by a case packing head, comprising: first means for receiving and aligning containers in a plurality of rows, said rows being spaced and separated from each other; and second means for separating said containers in each said row from each other within said row.

Other aspects of the invention are achieved by a case packing head for receiving and releasing an ordered arrangement of containers, comprising: a grid for aligning said containers into rows; longitudinal fingers extending from a bottom portion of said grid substantially parallel to said rows; cross fingers extending from a bottom portion of said grid substantially perpendicular to said rows, said cross fingers having top edge portions extending upwardly toward said rows; and means for separating said containers of each said row from adjacent containers in the same row and establishing a space therebetween, said spaces being aligned with said top edge portions of said cross fingers.

DESCRIPTION OF THE DRAWINGS

For a complete understanding of the objects, techniques, and structure of the invention, reference should be had to the following detailed description and accompanying drawings wherein:

FIG. 2, comprising FIG. 3, comprising

BEST MODE FOR CARRYING OUT THE INVENTION

Figure 1A:
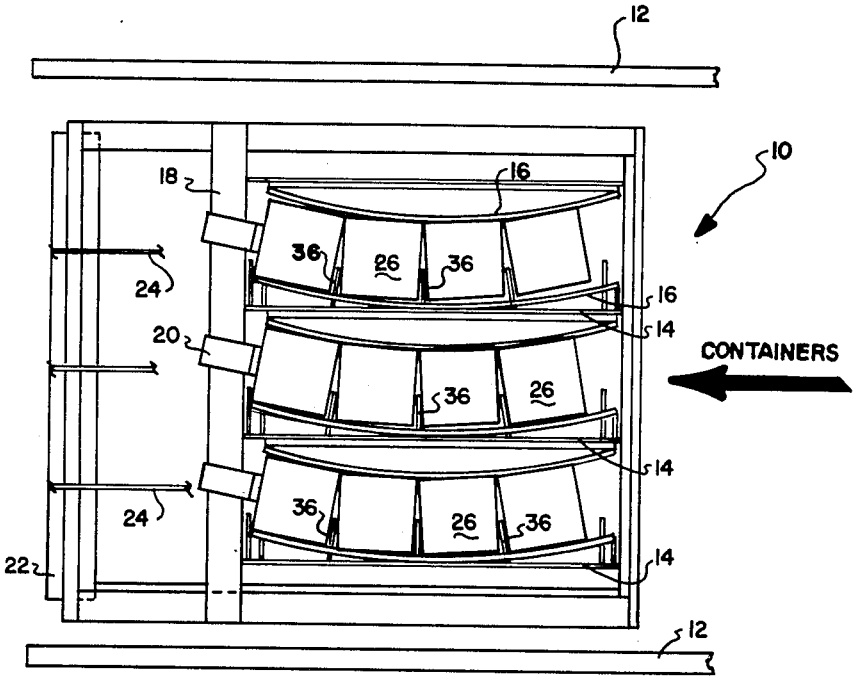
FIG. 1, comprising FIGS. 1A and 1B, respectively shows an illustrative top plan view of a first embodiment of the invention and a front perspective view of the same embodiment.
Figure 1B:
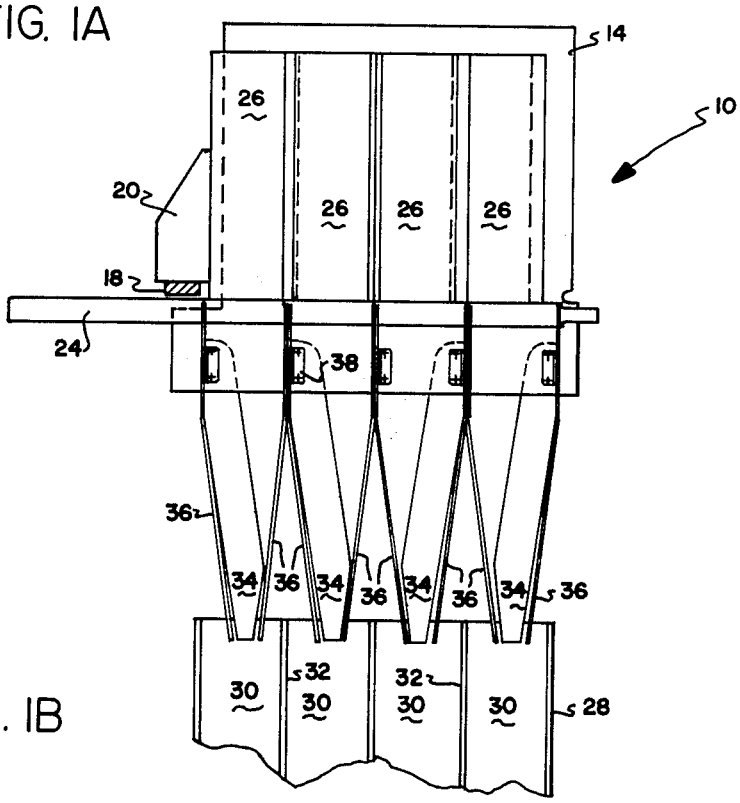

With reference now to FIGS. 1A and 1B, it can be seen that a first embodiment of the invention consists of a case packing head designated generally by the numeral 10. The assembly 10 includes a head frame 12 which is typically stationary, being interconnected with the case packing line. A plurality of grids or divider plates 14 form three paths or lanes for entrance of containers from a conveyor as shown by the arrow in FIG. 1A.

Unlike prior packing heads, the actual paths for the containers are defined by a pair of arcuate plates 16 interposed between each pair of grids 14 as shown. The purpose of the arc of the path, to separate the containers from each other, will be discussed further herein. Suffice it to say that the degree of arc of the plates 16 is set to achieve the desired separation of the containers. In a preferred embodiment of the invention, it was found that plates 16 which were fifteen inches in length and which had a maximum deflection of $\frac{3}{4}$ inch from the associated grid plate 14 which it contacts gave sufficient separation of the containers.

As further shown in FIG. 1, a bar 18 receives thereon a plurality of stop blocks 20, one associated with each of the container paths. As is well known in the art, the stop blocks 20 may have associated therewith fill safety devices and the like. It will further be noted that the stop blocks 20 are angled with respect to the bar 18 such as to be aligned with the associated container path.

A shifting frame 22 has extending therefrom a plurality of skid blades or bars 24, one between each of the grids 14 for purposes of receiving and supporting the containers 26. Again, skid blades and shifting frames are well known in the art of packing heads. In standard fashion, when the shifting frame 22 is shifted such that the skid blades 24 pull adjacent the grids 14, the containers 26 drop through the head and into the carton or case 28 therebelow. Pockets 30 characterize the container 28 as formed by partitions 32. Again in standard fashion, the containers 26 are directed into the associated pockets 30 by longitudinal fingers 34 which are parallel and connected to the grids 14, and cross fingers 36 which are connected and perpendicular to the grids 14, secured thereto by means of the clips 38. It will be noted that the cross fingers 38 extend upwardly to a point substantially in plane with the bottoms of the containers 26 when they are supported upon the skid blades 24. In other words, the tops of the cross fingers 36 are in the area of $\frac{1}{4}$ inch to $\frac{3}{4}$ inch beneath the plane defined by the top edges of the skid blades 24.

In operation, the curved paths defined by the arcuate plates 16 separate the square or rectangular containers 26 by a wedge which is aligned with a top edge of an associated cross finger as is best shown in FIG. 1A. It will, of course, also be noted that the cross fingers 36 only extend from one of each pair of lane dividers 14, not from both. When the frame 22 is shifted such that the skid blades 24 move from under the containers 26, the containers drop past the top edges of the cross fingers 36 and are directed into the pockets 30 by the fingers 34,36. Accordingly, there is no chance that the rectangular containers 26 might be caught by the top edges of the cross fingers 36, particularly due to the fanning nature of the containers in the arcuate path, providing wedge-shaped openings above the top edges of the cross fingers 36 which are maintained immediately beneath the plane of the containers 26. The fanning of the containers to separate the corner edges in alignment with the cross fingers allows for the successful operation of this embodiment of the invention.

Figures 2A, 2B, 2C:
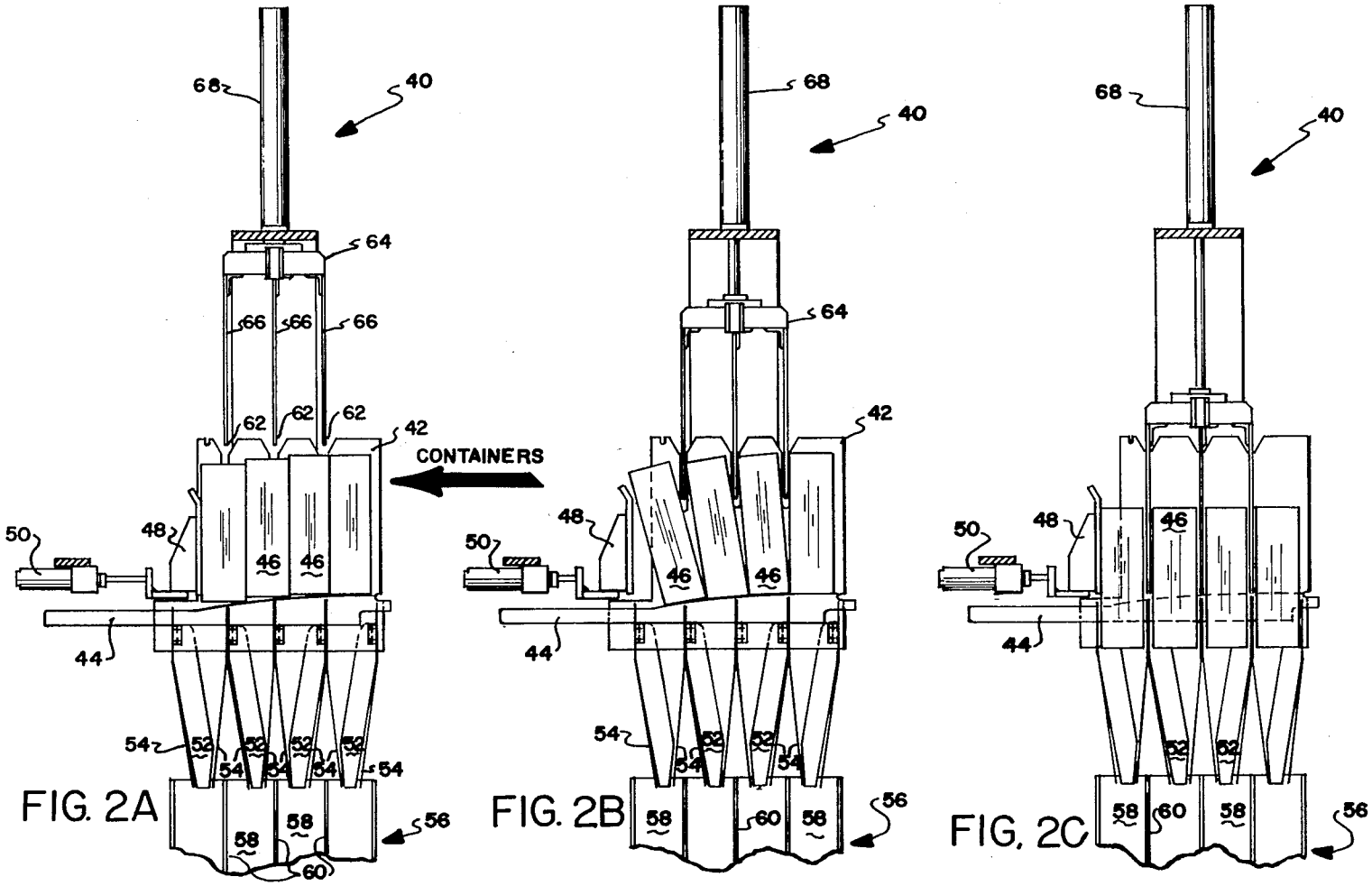
FIGS. 2A–2C, presents front perspective views of a second embodiment of the invention showing the sequential steps of operating the same.

A second embodiment of the invention is shown in FIG. 2 wherein the packing head is designated generally by the numeral 40. Again, packing head 40 would typically comprise three rows or paths for containers moving thereinto in the direction of the arrow in FIG. 2A. The paths or lanes would be defined by grid plates or lane dividers 42 in standard fashion. Skid blades 44 are maintained between the grid plates 42 to provide support surfaces for receiving the containers 46 as they are moved into the head 40. As shown, the skid blades 44 are of decreasing height when taken in the direction of the movement of the containers 46 such that the tops of the containers present a staircase effect, each container being slightly lower than the subsequent container following it into the head.

A stop block 48 is associated with each lane of the packing head 40, with the stops 48 being connected to and actuated by an appropriate pneumatic cylinder 50, the purpose of such actuation becoming apparent hereinafter.

Longitudinal fingers 52 are connected and parallel to the grid plates 42, while the cross fingers 54 are connected and perpendicular to such plates 42 as previously discussed. As shown, the cross fingers 54 extend upwardly to a point in proximity to the bottom of the containers with the extensions being progressively shorter in the direction of container movement so as to track the declination of the skid blades 44. Again, the tops of the cross fingers 54 are preferably $\frac{1}{4}$ inch $\frac{3}{4}$ inch from the top of the skid bar 44 at the nearest point of proximity.

Beneath the head 40 is a carton or case 56 having pockets 58 defined by partitions 60. These pockets communicate with the fingers 52,54 for receiving the containers 46 therein upon actuation of the packing head.

It will be noted that the grid plates 42 each have slots 62 therein, there being three such slots in the embodiment shown. A separator grid 64 is maintained above the grid plates 42 with the separator grid 64 having three plates 66, one aligned with each of the slots 62 of the grid plates 42. A pneumatic cylinder 68 is operative for extending and retracting the separator grid 64 into and out of the slots 62 of the grid 42.

The operation of this embodiment of the packing head may be readily perceived from a review of FIGS. 2A–2C. As shown in FIG. 2A, a full complement of, in this example, twelve rectangular containers 46 has been received by the grid arrangement 42 and are maintained in a staircase configuration due to the declination of the supporting skid blades 44. At this point, the containers 46 are stopped and held by the extended stop blocks 48.

With the full complement of containers received by the packing head, the operation of FIG. 2B is entered into. Here, the pneumatic cylinder 50 acts to retract the stops 48, allowing the containers 46 to tilt toward the retracted stops 48 due to the declination of the skid blades 44. This tilting fans the containers 46 and provides openings of a wedge-shaped nature therebetween. These openings are aligned with the plates 66 of the separator grid 64, which plates are also aligned directly with the top edges of the cross fingers 54.

Next, as shown in FIG. 2C, the separator grid 64 is driven between the cases 46 by the pneumatic cylinder 68 such that the ends of the plates 66 are in direct alignment with the top edges of the cross fingers 54 and maintained immediately above the top edge surfaces of the skid blades 44. The cartons 46 are thus in perfect vertical alignment above the associated pocket 58 of the container 56 for passage through the fingers 52,54. It should be noted that the stops 48 are withdrawn by the cylinder 50 to a point in alignment with the end cross fingers 54 as shown. Accordingly, the leading containers 56 are also maintained in a total upright position. With this alignment, the skid blades 44 are shifted as by a shifting frame in normal fashion. The containers 46 pass through the grid and through the arrangement of fingers 52,54 and into the pockets 58. In standard fashion, the filled case is then lowered and replaced with an empty case for repeated action.

With final attention to FIG. 3, yet another embodiment of the invention can be seen. In this embodiment, the packing head is designated generally by the numeral 70 and consists of a grid plate 72 for dividing the packing head into lanes, such as three, as previously discussed. Stop blocks 74, one at the end of each lane are maintained upon a stop block bar 76. A pneumatic cylinder 78 is connected to the bar 76 for movement of the stops 74 longitudinally with respect to the lanes of the head. The containers 80, of rectangular cross section, move into the lanes in the direction of the arrow as shown.

Longitudinal fingers 82 are parallel and connected to the grid plates 72, while the cross fingers 84 are perpendicular and connected to such grid plates as previously discussed. The fingers 82,84 define passages from the lanes of the head into pockets of a case or container therebelow.

A skid blade assembly 86 is centered beneath each lane of the head 70 in somewhat standard fashion. Unique to the concept of the invention, however, is that each skid blade assembly comprises a sliding blade 88 received upon a stationary blade 90. The stationary blade 90 is maintained between a rear blade bar 92 and a front blade bar 94 with the sliding blade 88 free for limited sliding movement upon the stationary blade 90 by means of the slot 96 in the sliding blade 88 and the slot 98 in the stationary blade 90.

The end of the sliding blade 88 is received within a slot in the rear blade bar 92 such that the slot 96 allows for limited reciprocating longitudinal movement of the sliding blade 88 by means of the slot 96 being received over the pin 100. Further sliding engagement is achieved by means of the slide 102 which is connected to the sliding blade 88 and received in the slot 98 of the stationary blade 90. The slide 102 is connected to the block 104 as shown. Extending from the top of the block 104 is a roller 106 which is received in a slot or way 108 in the stop block bar 76. Such roller and slot engagement 106,108 allows for transverse movement of the skid blade assemblies 86 to achieve release of the containers from the head for dropping into a carton below.

It will also be appreciated that the structure of the invention also includes front and rear grid bars 110,112 to hold the grids 72. Also provided is a spring 114 about the stationary blade 90 and tensioning the blade by means of compression of the spring 114 between the pin 116 and front blade bar 94. It should be particularly noted that the pneumatic cylinder 78 is not connected to the front blade bar 94.

Figure 3A:
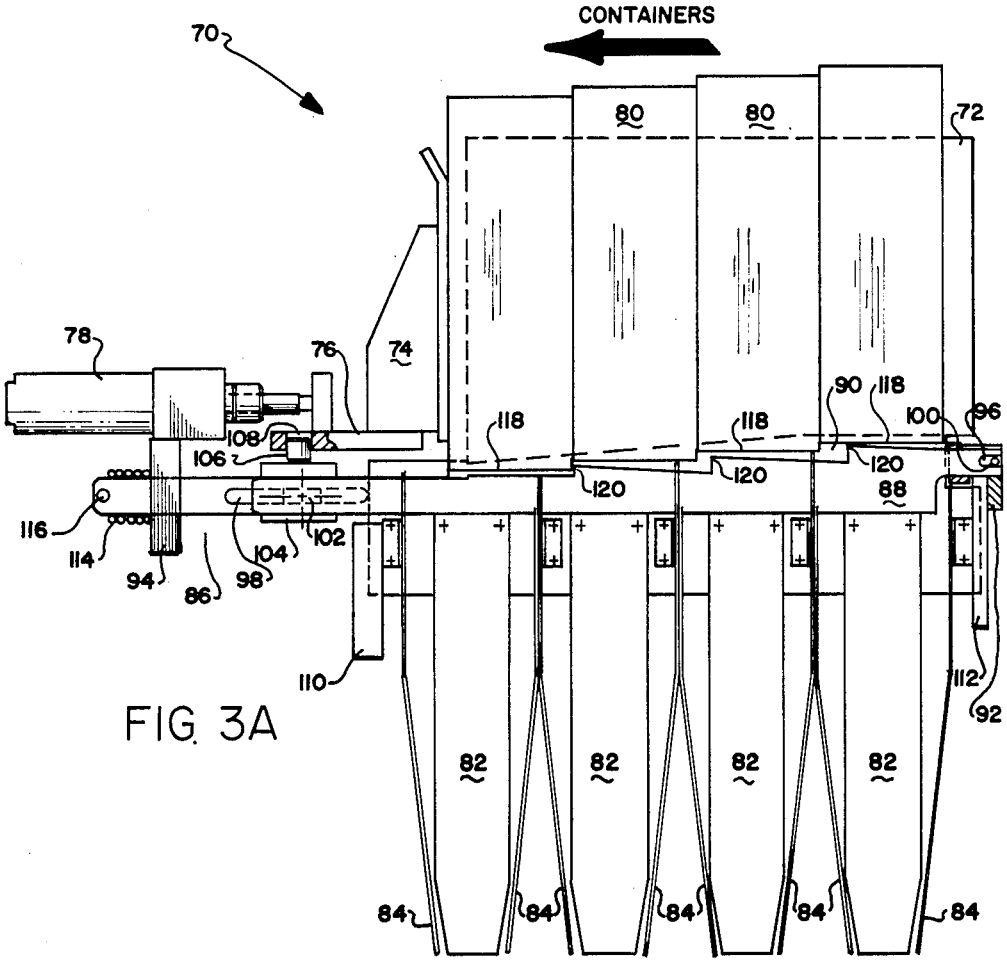
FIGS. 3A–3D, shows front perspective views of a third embodiment of the invention and the operation of the same (FIGS. 3A and 3C), and partial sectional views of the actuating mechanism for the skid blades of the head in operation (FIGS. 3B and 3D).

The stationary blades 90 are characterized by plateaus 118 of descending heights when taken in view of the direction of container movement. The plateaus are of a width approximately equal to the width of the containers 80 to be received. The sliding blades 88 are characterized by a plurality of teeth 120 such that the sliding blade 88 has a sawtooth configuration. The peak of each tooth 120 is higher than the next tooth in the direction of container flow. Further, it is preferred that the peak of each tooth is above the lowest point of the trough of the immediately prior tooth when taken in the direction of container flow. It should further be noted that the teeth 120 are equally spaced along the sliding blade 88 with such spacing corresponding to the spacing of the top edges of the cross fingers 84. As shown in FIG. 3A, when the containers 80 are being received by the head 70, the far most tooth 120 is aligned with the edge of the first plateau of the blade 90, while the second tooth is spaced from the edge of the second plateau and the third tooth is spaced even more from the edge of the third plateau 118.

Figure 3B:
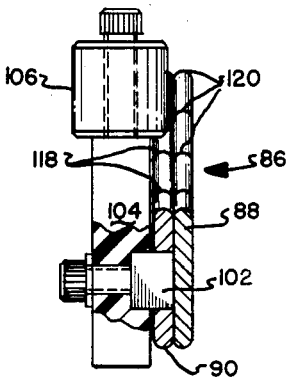
Figure 3C:
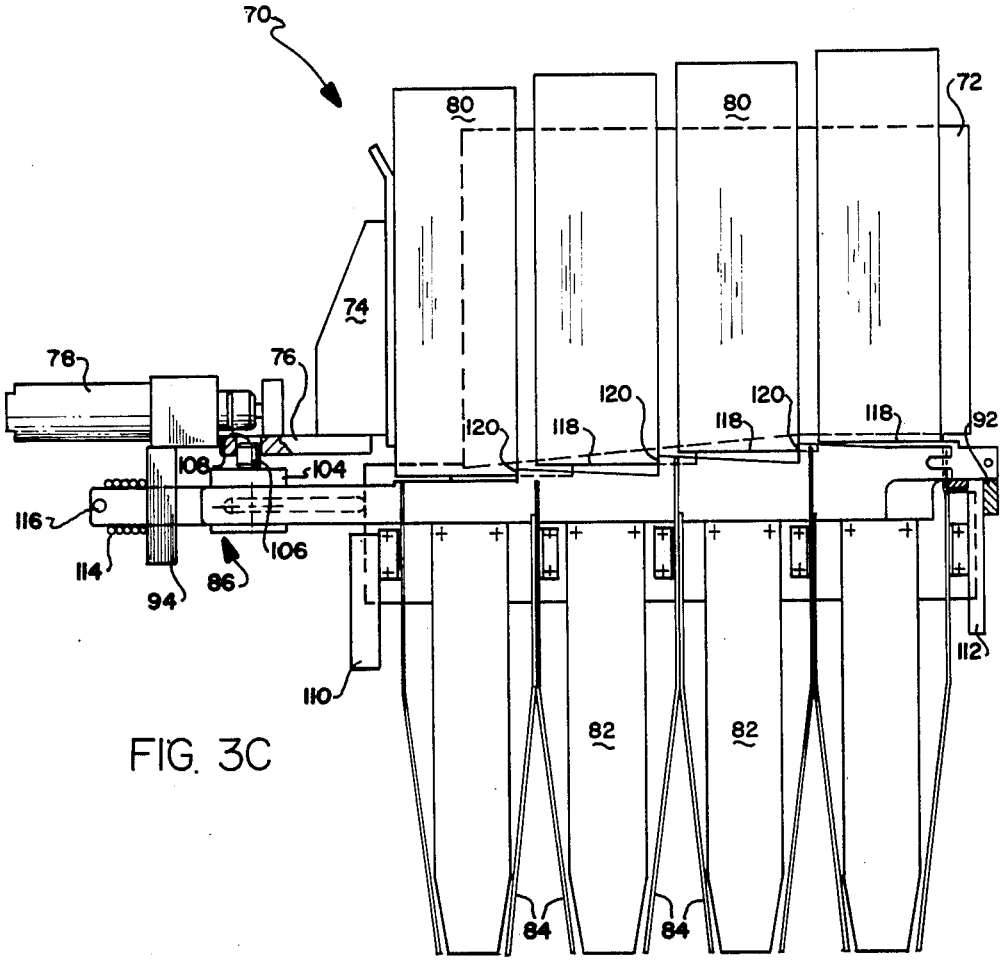
Figure 3D:
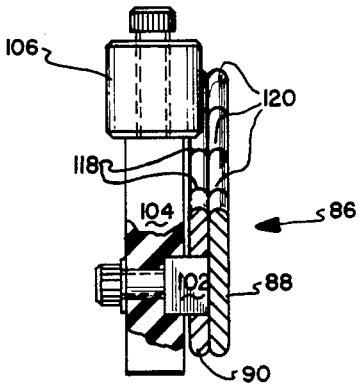

FIG. 3B shows a sectional view of a grid blade assembly 86 in the condition of FIG. 3A, while FIG. 3D shows such arrangement in the condition of FIG. 3C which will be discussed directly below.

In operation, when a complement of containers is received by the lanes of the packing head, the cylinder 78 is actuated to withdraw the stop blocks 74 to be aligned with the top edge of the far most cross finger 84. The actuation of the cylinder 78 also causes withdrawal of sliding blade 88 upon the stationary blade 90 as by engagement of the slide 102 within the slot 98. The movement of the sliding blade 88 causes the teeth 120 to engage the edges of the containers 80 and to move the same a distance determined by the distance of movement of the blade 88. For this purpose, it is well to note that the teeth 120 of the sliding blade 88 extend above the height of the next succeeding plateau 118 of the stationary blade 90 such that withdrawal of the blade 88 allows the teeth to contact and move the containers along the associated plateau 118. The teeth 120 are so positioned that the movement of the blade 88 causes the containers to be spaced with openings therebetween in alignment with the top edges of the cross fingers 84. In a preferred embodiment of the invention, the blade 88 moves $1\frac{1}{8}$ inch by actuation of the cylinder 78 such that the left most container 80 moves $1\frac{1}{8}$ inch, the next container moves $\frac{3}{4}$ inch, the next $\frac{3}{8}$ inch, and the last does not move at all. The result is a spacing between containers 80 of $\frac{3}{8}$ inch centered above the top edge of a cross finger 84.

With the cylinder 78 having moved both the stop block 74 and the sliding blade 88 as just described, the containers 80 are positioned above the associated pockets of the case below and in alignment with the associated fingers for directing their drop into the case. Further, the containers 80 are spaced from the top edges of the cross fingers. At this point in time, the skid blade frame is shifted as is standard in the art such that the skid blade assemblies 86 slide from beneath the containers 80 allowing the containers to drop through the fingers 82,84 and into the case below. Again, such positioning and operation is best shown in FIGS. 3C and 3D. The shifting of the skid blade assemblies 86 is facilitated by the rollers 106 within the slots 108 of the stationary stop block bar 76.

It will be appreciated that the embodiment of FIG. 3 provides for skid blade assemblies which move both longitudinally of the grid lanes to obtain separation of the containers and transversely of the grid lanes to allow the containers to drop. Such orthogonal movements of the skid blade assemblies allow the assemblies to perform a dual function which achieves the effective packaging of rectangular containers.

Thus it can be seen that the objects of the invention have been satisfied by the structures presented hereinabove. While in accordance with the patent statutes only the best mode and preferred embodiments of the invention have been presented and described in detail, it is to be understood that the invention is not limited thereto or thereby. Accordingly, for an appreciation of the true scope and breadth of the invention reference should be had to the following claims.

What is claimed is:

1. A case packing head, comprising:

first means for receiving and aligning containers in a plurality of rows, said rows being spaced and separated from each other; and second means for separating said containers in each said row from each other within said row, said second means comprising arcuate plates defining a curved path for said containers to travel in each said row, said paths being defined by concentrically spaced pairs of said arcuate plates.

2. The case packing head according to claim 1 wherein said first means comprises a skid blade maintained between each said pair of arcuate plates for receiving and supporting said containers thereon, said skid blades reciprocatingly movable from beneath said containers.

3. The case packing head according to claim 1 wherein said pairs of arcuate plates fan said containers in said respective paths to define a wedge-shaped opening between adjacent containers.

4. A case packing head for receiving said releasing an ordered arrangement of containers, comprising:

a grid for aligning said containers into rows;

longitudinal fingers extending from a bottom portion of said grid substantially parallel to said rows;

cross fingers extending from a bottom portion of said grid substantially perpendicular to said rows, said cross fingers having top edge portions extending upwardly toward said rows; and means for separating said containers of each said row from adjacent containers in the same row and establishing a space therebetween, said spaces being aligned with said top edge portions of said cross fingers, said means comprising pairs of arcuate plates interposed within said grid for arcuately defining said rows, wherein said pairs of arcuate plates fan said containers to define said spaces therebetween.

5. A case packing head, comprising:

first means for receiving and aligning containers in a plurality of rows, said rows being spaced and separated from each other; and second means for separating said containers in each row from each other within said row, said second means comprising a stop block at an end of each said row for inhibiting movement of containers in said rows, and a skid blade at the bottom of each said row, a top surface of said skid blade angling downwardly toward an associated one of said stop blocks, said stop blocks being retractable from said end of said associated row, and wherein said second means further comprises a separator grid in selective transverse communication with said rows.

6. The case packing head according to claim 5 wherein said separator grid comprises a plurality of spaced-apart parallel plates which are maintained normal to said rows.

7. A case packing head, comprising:

first means for receiving and aligning containers in a plurality of rows, said rows being spaced and separated from each other; and second means for separating said containers in each said row from each other within said row, said second means comprising a skid blade assembly beneath each said row for supporting said containers and adapted for reciprocating movement both parallel and normal to said rows, said skid blade assembly comprising a pair of blades adapted for relative movement with respect to each other.

8. The case packing head according to claim 7 wherein a first blade of said pair is fixed upon a frame and a second blade of said pair is slidably maintained adjacent said first blade.

9. The case packing head according to claim 8 wherein said second blade includes a plurality of means for contacting respective ones of said containers and moving the same along said first blade.

10. The case packing head according to claim 9 wherein said contacting means comprise teeth of different elevations.

11. The case packing head according to claim 10 wherein said first blade is characterized by a top surface having a staircase configuration of plateaus of progressively lower elevations.

12. The case packing head according to claim 8 wherein a container stop is maintained at an end of each said row, said container stop connected to retraction means for selectively retracting said container stop from said end of said row.

13. The case packing head according to claim 12 wherein said retracting means is further connected to said second blade for moving said second blade with respect to said first blade.

14. A case packing head for receiving and releasing an ordered arrangement of containers, comprising:

a grid for aligning said containers into rows;

longitudinal fingers extending from a bottom portion of said grid substantially parallel to said rows;

cross fingers extending from a bottom portion of said grid substantially perpendicular to said rows, said cross fingers having top edge portions extending upwardly toward said rows;

means for separating said containers of each said row from adjacent containers in the same spaces being aligned with said top edge portions of said cross fingers, said means comprising a stop block at an end of each said row, said stop block adapted for inhibiting movement of containers in said associated row and subsequentially allowing limited movement of said containers within said row, said stop block being controlled by a cylinder for reciprocating movement between two points; and skid blades maintained within said rows for receiving and supporting said containers, said skid blades adapted for lateral shifting movement within said rows for releasing said containers to drop through said fingers, each said skid blade comprising gripping means movable longitudinally within an associted one of said rows for contacting and moving containers within said row from each other to establish said space.

15. The case packing head according to claim 14 wherein said gripping means comprise protruding edges on said skid blade, said edges spaced apart the same as spacing of said top edges of said cross fingers.

16. The case packing head according to claim 15 wherein said protruding edges are maintained on a first blade maintained adjacent a second blade, said second blade having a top surface characterized by a plurality of parallel flat surfaces at progressively lower elevations, said first blade being movable in a first direction relative to said second blade and in a second direction with said second blade for said lateral shifting movement.

17. The case packing head according to claim 16 wherein said stop blocks are connected to said second blades and movable therewith.

18. A case packing head for receiving and releasing an ordered arrangement of containers, comprising:

a grid for aligning said containers into rows;

longitudinal fingers extending from a bottom portion of said grid substantially parallel to said rows;

cross fingers extending from a bottom portion of said grid substantially perpendicular to said rows, said cross fingers having top edge portions extending upwardly toward said rows;

means for separating said containers of each said row from adjacent containers in the same row and establishing a space therebetween, said spaces being aligned with said top edge portions of said cross fingers, said means comprising a stop block at an end of each said row, said stop block adapted for inhibiting movement of containers in said associated row and subsequentially allowing limited movement of said containers within said row;

a separating grid in selective communication with said rows, separating the containers in each row from each other, said separating grid comprising a plurality of plates transversing said rows and aligned with said top edge portions of said cross fingers;

and skid blades maintained within said rows for receiving and supporting said containers, said skid blades adapted for lateral shifting movement within said rows for releasing said containers to drop through said fingers top surfaces of said skid blades being angled toward said stop blocks.

19. The case packing head according to claim 18 wherein said stop block is controlled by a cylinder for reciprocating movement between two points.

* * * * *